US008926009B1

(12) United States Patent
LaPointe

(10) Patent No.: US 8,926,009 B1
(45) Date of Patent: Jan. 6, 2015

(54) COVERED LEG REST LINKAGE FOR FURNITURE MEMBER

(71) Applicant: La-Z-Boy Incorporated, Monroe, MI (US)

(72) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 1 day.

(21) Appl. No.: 13/948,506

(22) Filed: Jul. 23, 2013

(51) Int. Cl.
*A47C 1/035* (2006.01)
*A47C 7/50* (2006.01)
*A47C 20/00* (2006.01)

(52) U.S. Cl.
CPC ..... *A47C 7/506* (2013.01)
USPC ..... 297/85 M; 297/423.28; 297/423.37

(58) Field of Classification Search
USPC ..... 297/85 M, 423.22, 423.23, 423.24, 297/423.26, 423.28, 423.37
See application file for complete search history.

(56) References Cited

U.S. PATENT DOCUMENTS

| | | | | |
|---|---|---|---|---|
| 478,247 | A * | 7/1892 | Valentine | 297/423.23 X |
| 834,376 | A * | 10/1906 | Flindall | 297/423.2 X |
| 1,262,216 | A * | 4/1918 | Lee | 297/423.37 X |
| 3,137,528 | A * | 6/1964 | Bottemiller | 297/423.37 |
| 5,088,789 | A | 2/1992 | LaPointe et al. | |
| 5,156,441 | A | 10/1992 | Byersmith et al. | |
| 5,217,276 | A | 6/1993 | LaPointe et al. | |
| 5,374,108 | A | 12/1994 | Saul et al. | |
| 5,388,886 | A | 2/1995 | LaPointe et al. | |
| 5,435,622 | A | 7/1995 | Fay et al. | |
| 5,503,453 | A | 4/1996 | Saul et al. | |
| 5,582,457 | A | 12/1996 | Komorowski et al. | |
| 5,765,913 | A | 6/1998 | LaPointe et al. | |
| 5,806,921 | A | 9/1998 | LaPointe et al. | |
| 5,842,743 | A | 12/1998 | Wright et al. | |
| 5,845,961 | A | 12/1998 | LaPointe et al. | |
| 5,890,765 | A | 4/1999 | LaPointe et al. | |
| 5,954,392 | A | 9/1999 | Liss et al. | |
| 5,975,627 | A | 11/1999 | LaPointe et al. | |
| 5,992,930 | A | 11/1999 | LaPointe et al. | |
| 5,992,931 | A | 11/1999 | LaPointe et al. | |
| 6,409,262 | B1 | 6/2002 | LaPointe | |
| 6,655,732 | B1 | 12/2003 | LaPointe | |
| 6,893,085 | B2 | 5/2005 | LaPointe et al. | |
| 6,896,323 | B2 | 5/2005 | LaPointe et al. | |
| 7,338,132 | B2 | 3/2008 | LaPointe | |
| 7,585,018 | B2 | 9/2009 | LaPointe et al. | |
| 7,850,245 | B2 * | 12/2010 | Ton | 297/423.26 X |

(Continued)

*Primary Examiner* — Rodney B White
(74) *Attorney, Agent, or Firm* — Harness, Dickey & Pierce, P.L.C.

(57) ABSTRACT

A furniture member includes a leg rest assembly connected to a base frame of a furniture member and extensible away from a stowed position by movement in a direction coincident with a lateral centerline of the furniture member to a fully extended position. A leg rest mechanism is connected to the base frame and the leg rest assembly. A linkage assembly includes a first clamshell housing rotatably connected to the leg rest mechanism having a first extension link also rotatably connected to the leg rest mechanism positioned within the first clamshell housing. A second clamshell housing is rotatably connected to the first clamshell housing and to a leg rest mount board of the leg rest assembly having a first mount board link positioned within the second clamshell housing also rotatably connected to the first clamshell housing and to the leg rest mount board.

29 Claims, 11 Drawing Sheets

(56) References Cited

U.S. PATENT DOCUMENTS

| | | | | |
|---|---|---|---|---|
| 7,967,383 | B2 | 6/2011 | LaPointe | |
| 8,079,645 | B2 | 12/2011 | LaPointe | |
| 8,132,855 | B2 | 3/2012 | Richard | |
| 8,205,936 | B2 * | 6/2012 | Alessandro | 297/423.37 X |
| 8,366,188 | B2 | 2/2013 | Adams et al. | |
| 8,398,169 | B2 | 3/2013 | LaPointe | |
| 8,459,732 | B2 | 6/2013 | LaPointe et al. | |
| 8,506,009 | B2 | 8/2013 | LaPointe et al. | |

* cited by examiner

COVERED LEG REST LINKAGE FOR FURNITURE MEMBER

FIELD

The present disclosure relates to extensible and retractable leg rest assemblies for furniture members such as chairs, recliners, ottomans, couches, and loveseats.

BACKGROUND

This section provides background information related to the present disclosure which is not necessarily prior art.

Furniture members such as chairs, recliners, ottomans, couches, and loveseats may include a leg rest assembly that is extended either manually or by powered operation, which provides support for the legs and feet of an occupant when positioned at a fully extended position. Known leg rest mechanisms commonly permit the leg rest assembly to extend directly outward and retract along a furniture member lateral centerline. A locking or latching portion retains the leg rest assembly in the extended position until the occupant retracts the leg rest assembly. While the leg rest is in the extended position, the leg rest prohibits easy egress from the chair; therefore, the leg rest assembly must be retracted before the occupant can exit the furniture member. Because the leg rest assembly extends in only a single outward direction, an intermediate cover, normally including upholstery, is provided between the base of the furniture member and the leg rest such that the intermediate cover prevents direct access by the occupant to the pantograph links used to extend the leg rest.

SUMMARY

This section provides a general summary of the disclosure, and is not a comprehensive disclosure of its full scope or all of its features.

According to several aspects, a furniture member leg rest assembly includes a leg rest assembly connected to a base frame of a furniture member and extensible away from a stowed position by movement in a direction coincident with a lateral centerline of the furniture member to a fully extended position of the leg rest assembly. A leg rest mechanism is connected to the base frame and the leg rest assembly. A linkage assembly includes: a first clamshell housing rotatably connected to the leg rest mechanism; and a second clamshell housing rotatably connected to the first clamshell housing and to a leg rest mount board of the leg rest assembly.

According to further aspects, a furniture member includes a leg rest assembly connected to a base frame of a furniture member and extensible away from a stowed position by movement in a direction coincident with a lateral centerline of the furniture member to a fully extended position. A leg rest mechanism is connected to the base frame and the leg rest assembly. A linkage assembly includes a first clamshell housing rotatably connected to the leg rest mechanism having a first extension link also rotatably connected to the leg rest mechanism positioned within the first clamshell housing. A second clamshell housing is rotatably connected to the first clamshell housing and to a leg rest mount board of the leg rest assembly having a first mount board link positioned within the second clamshell housing also rotatably connected to the first clamshell housing and to the leg rest mount board.

According to other aspects, a furniture member includes a leg rest mechanism connected to a base frame of the furniture member. A leg rest assembly is connected to the leg rest mechanism and is extensible away from a stowed position to a fully extended position of the leg rest assembly by operation of an electric motor. The leg rest assembly includes a linkage assembly having first and third clamshell housings individually rotatably connected to the leg rest mechanism. Second and fourth clamshell housings are each rotatably connected to one of the first or third clamshell housings and are both further rotatably connected to a leg rest mount board. A pin rotatably connecting the leg rest mechanism to the base frame defines a leg rest axis of rotation permitting the leg rest assembly to be manually rotated by an occupant of the furniture member about the leg rest axis of rotation to each of a fully extended clockwise rotated position and a fully extended counterclockwise rotated position following operation of the electric motor extending the leg rest assembly to the fully extended position.

According to additional aspects, a furniture member leg rest assembly includes a leg rest assembly. A leg rest mechanism is connected to the leg rest assembly. A linkage assembly includes: a first clamshell housing rotatably connected to the leg rest mechanism having a first support link substantially enclosed within the first clamshell housing; and a second clamshell housing rotatably connected to the first clamshell housing and to a leg rest mount board of the leg rest assembly. The second clamshell housing has a first mount board link substantially enclosed within the second clamshell housing. The first and second clamshell housings together with the first support link and the first mount board link define structural support members for the leg rest mount board.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments, and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
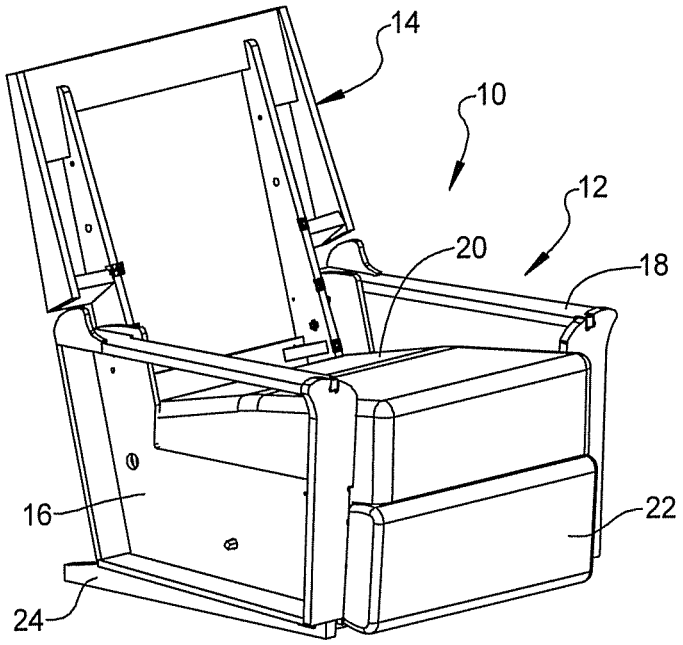
FIG. 1 is a front right perspective view of a furniture member having a center support leg rest assembly of the present disclosure.

Referring to FIG. 1, a furniture member 10, which is depicted as a rocking reclining chair, includes a base member 12 and a seat back 14 which is rotatable with respect to base member 12. Furniture member 10 is not limited by the reclining chair design shown and can be any type of furniture member also including a couch, a chaise, a loveseat, and the like. Base member 12 includes each of a first arm member 16 positioned on a right hand side of an occupant seated in furniture member 10 and a second arm member 18 positioned on a left hand side of the occupant. A seat member 20 is positioned between the first and second arm members 16, 18. A leg rest assembly 22 is positioned forward of the seat member 20 and is shown in its fully retracted position. The base member 12 and seat back 14 are together rotatably supported on a frame 24. For clarity, the base member 12 and seat back 14 are shown without upholstery, which would normally be present, and the seat member 20 and leg rest assembly 22 are shown with upholstery.

Referring to FIG. 2 and again to FIG. 1, with the seat back 14 in the fully upright position shown, the base member 12 can rotate in each of a rearward rotation direction "A" and a forward rotation direction "B". The frame 24 is designed to support base member 12 and directly contact a nominally planar floor surface 26 and thereby support the furniture member 10 on the floor surface 26.

Figure 2:
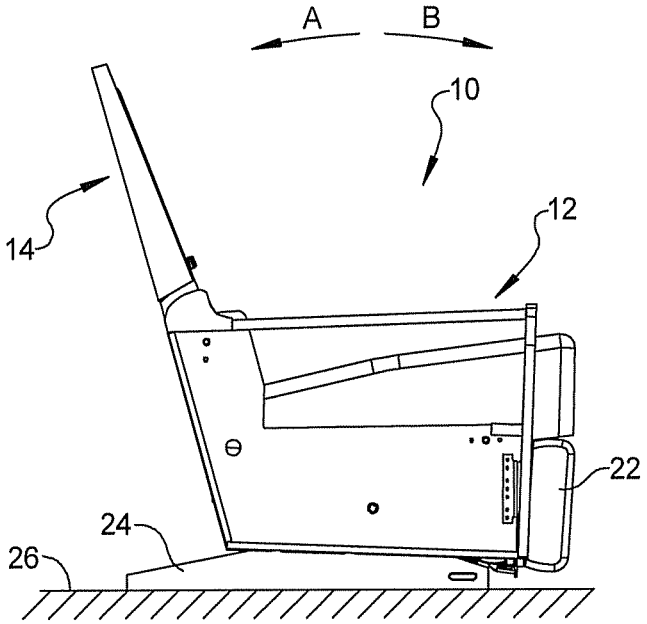
FIG. 2 is a right side elevational view of the furniture member of FIG. 1.

Referring to FIG. 3 and again to FIGS. 1 and 2, the leg rest assembly 22 is extensible from the stowed position, shown in FIGS. 1 and 2, to a fully extended position by operation of a leg rest mechanism 28. As the leg rest assembly 22 extends, the seat back 14 and base member 12 together rotate in a seat member rotation direction "C" with respect to frame 24. Leg rest assembly 22 extends in a leg rest extension direction "D" by operation of the leg rest mechanism 28 away from a frame panel 30 of base member 12. In its fully extended position, the leg rest assembly 22 is positioned forward of a forward seat face 32 of the seat member 20. Operation of the leg rest mechanism 28 to extend the leg rest assembly 22 rotates the base member 12 rearwardly in the seat member rotation direction "C", which also elevates a forward edge 33 of the base member 12 with respect to a forward frame member 34 of frame 24.

Referring to FIG. 4 and again to FIG. 3, to provide support for the legs of the occupant of furniture member 10 as well as the weight of the leg rest assembly 22 in its fully extended position, as the leg rest mechanism 28 actuates, a support foot 36 extends downwardly in a support foot extension direction "E" to make contact with the forward frame member 34 shown and described with reference to FIG. 3. The support foot 36 extends by operation of a support foot extension shaft 38. The support foot 36 in contact with the forward frame member 34 thereafter prevents rotation of base member 12 in the forward rotation direction "B" while the leg rest assembly 22 is in its extended position. According to several aspects, support foot 36 is a polymeric material, such as a molded polyamide material, to reduce its weight while providing rigidity.

Figure 3:
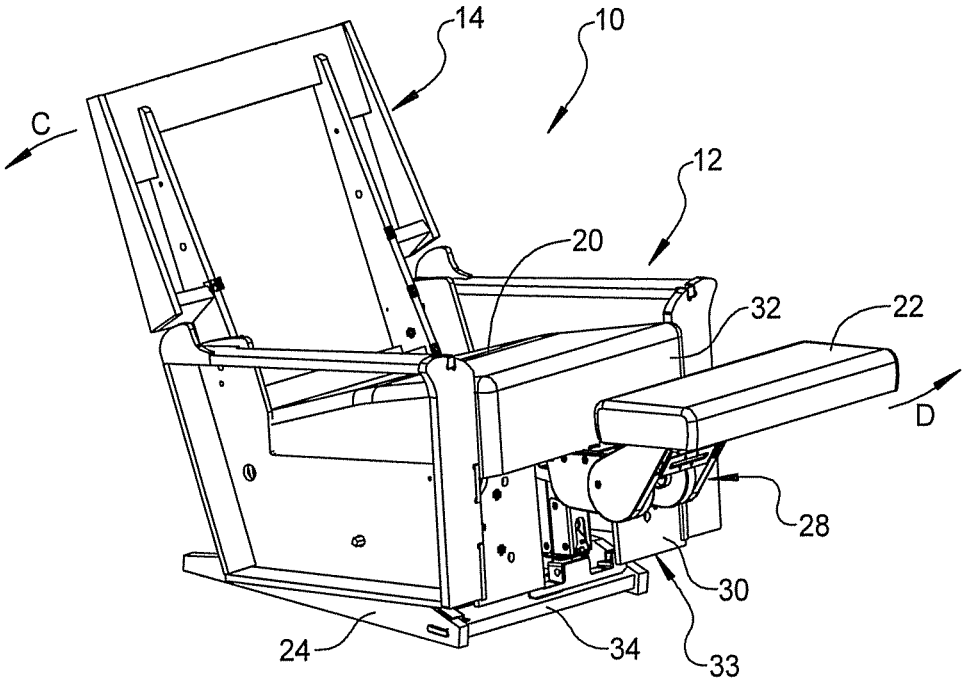
FIG. 3 is a front right perspective view similar to FIG. 1 further showing the leg rest assembly in a fully extended center position.
Figure 4:
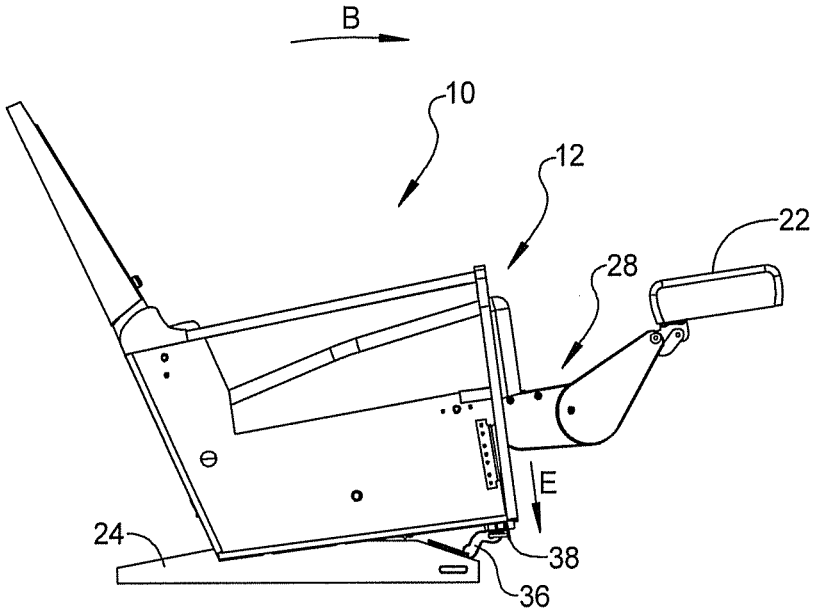
FIG. 4 is a right side elevational view of the furniture member of FIG. 2 with the leg rest assembly in the fully extended center position.

Referring to FIG. 5 and again to FIGS. 3-4, the leg rest assembly 22 is shown in the fully extended, center position, wherein leg rest assembly 22 is substantially centered with respect to a lateral centerline 40 of furniture member 10. The leg rest assembly 22 in this position therefore provides equal support for the right and left legs of the occupant of furniture member 10 when centered with respect to lateral centerline 40.

Figure 5:
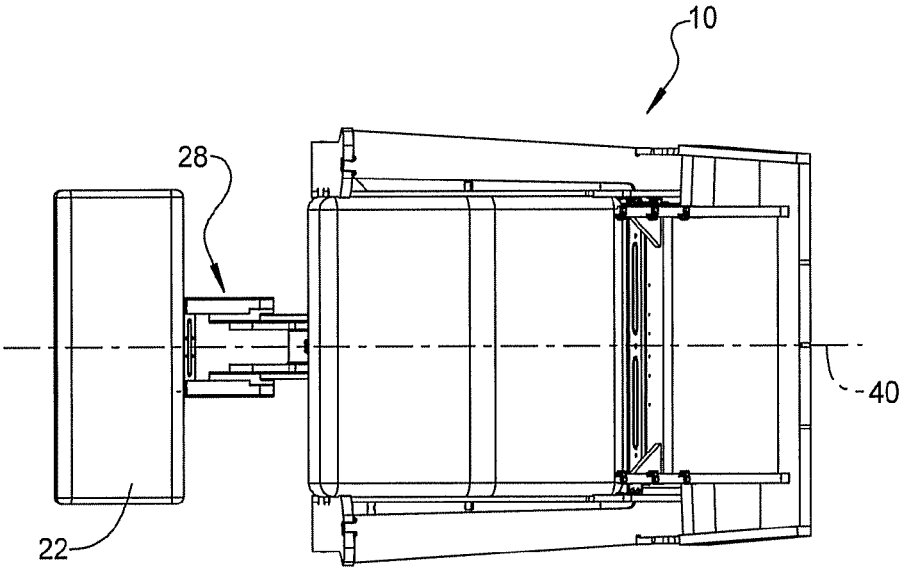
FIG. 5 is a top plan view of the furniture member of FIG. 3.

Referring to FIG. 6 and again to FIGS. 3-5, after the leg rest assembly 22 reaches the fully extended position, further operation of seat back 14 by rotation in a seat back reclining direction "F", as well as additional rotation of base member 12 in the rearward rotation "A", causes the support foot 36 to be repositioned freely above and therefore displace away from an upper surface 42 of the forward frame member 34. To therefore provide stability for base member 12 with the seat back 14 in the fully reclined position, a first and a second extension bracket 44, 46 together downwardly extend from each of the first and second arm members 16, 18 during rotation of the seat back 14. First extension bracket 44 contacts a right frame member 48 of frame 24, and second extension bracket 46 contacts a left frame member 50 of frame 24.

Opposite operation and rotation of seat back 14 with respect to the seat back reclining direction "F" returns seat back 14 toward its fully upright position shown in FIG. 1. During this return rotation, each of the first and second extension brackets 44, 46 retract upwardly into their respective first or second arm member 16, 18. This will initially return the support foot 36 into direct contact with forward frame member 34 until the leg rest assembly 22 is further rotated back toward its stowed position. Rotation of the leg rest assembly 22 away from the fully extended position and back toward its stowed position will upwardly retract the support foot 36, thereafter allowing free rotation of base member 12 with respect to frame 24.

Figure 6:
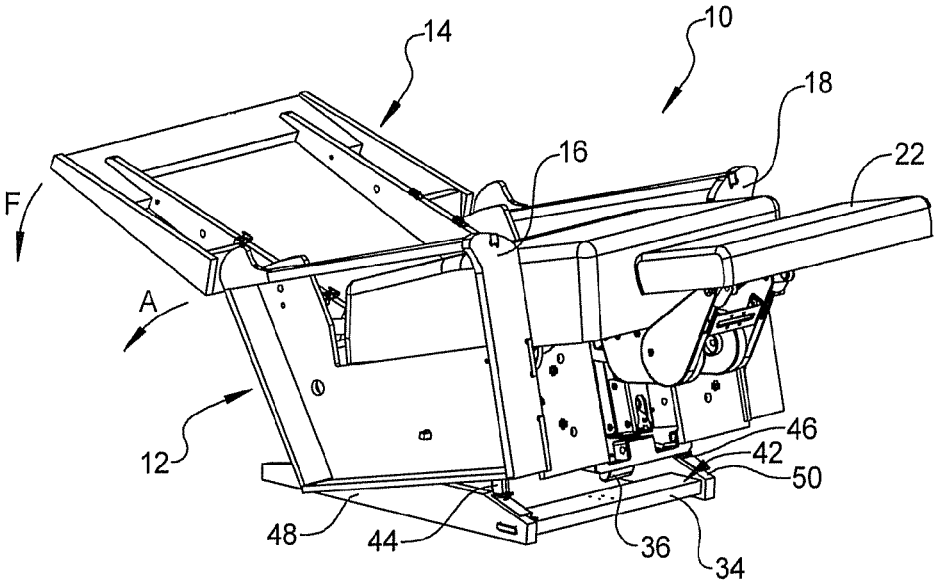
FIG. 6 is a front right perspective view modified from FIG. 3 to further show the seat back member in a fully reclined position.

Referring to FIG. 7 and again to FIGS. 5-6, with the leg rest assembly in the fully extended position, if the occupant presses one of their legs against a first leg rest face 56, the leg rest assembly 22 rotates in a counterclockwise direction of rotation "G" with respect to a leg rest axis of rotation 58. Leg rest axis of rotation 58 defines a rotational axis of the leg rest assembly 22 for rotation of the leg rest mechanism 28 with respect to base member 12. Leg rest assembly 22 will rotate in the counterclockwise direction of rotation "G" (as viewed from above furniture member 10) for a leg rest counterclockwise angle of rotation $\alpha$ of at least 30 degrees, and according to several aspects leg rest assembly 22 will rotate for approximately 45 degrees at its fully outward rotated position. At the counterclockwise fully rotated position of leg rest assembly 22, an egress space is provided for the occupant of the furniture member 10 to stand and exit furniture member 10 while the leg rest assembly 22 is maintained in the fully extended position.

Figure 7:
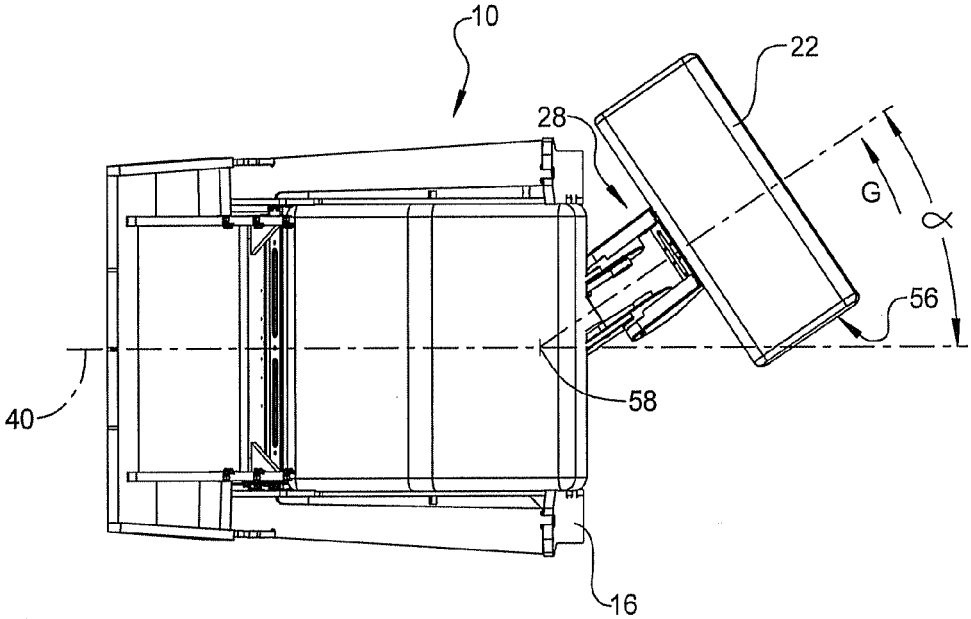
FIG. 7 is a top plan view of the furniture member with the leg rest assembly in a fully extended counterclockwise rotated position.

Referring to FIG. 8 and again to FIG. 7, by oppositely manually pressing against a second leg rest face 60 of leg rest assembly 22, the occupant of furniture member 10 can manually rotate leg rest assembly 22 in a clockwise direction of rotation "H" for a leg rest clockwise angle of rotation β. According to several embodiments, clockwise angle of rotation β is substantially equal to leg rest counterclockwise angle of rotation α and is therefore at least 30 degrees and according to several aspects is approximately 45 degrees of clockwise rotation. An egress space is also provided at the clockwise fully rotated position of leg rest assembly 22 for the occupant of the furniture member 10 to stand and exit furniture member 10, while the leg rest assembly 22 is maintained in the fully extended position.

Referring to FIG. 9 and again to FIGS. 1-8, the leg rest mechanism 28 is shown in greater detail. A first panel bracket 62 and an oppositely positioned second panel bracket 64 are fixedly connected to a first and a second support tube 66, 68, and connect the first and second support tubes 66, 68 to the first and second arm members 16, 18. The frame panels 30 which are connected to the first and second support tubes 66, 68 provide support for upholstery. The first and second support tubes 66, 68 also provide rigidity for the leg rest mechanism 28 and support the weight of the leg rest mechanism 28 when extended. According to several aspects, the first and second support tubes 66, 68 are rectangular tubing which are formed in a U-shape, providing clearance peripherally about the elements of leg rest mechanism 28 as well as rigidity. A mechanism housing 70, created from a metal material such as steel, is supported by a structure connected to each of the first and second support tubes 66, 68. The mechanism housing 70 is positioned in a vertical orientation having the leg rest axis of rotation 58 extending centrally therethrough.

A first motor support link 72 and a second motor support link 74 are both rotatably connected to the structure of mechanism housing 70. A support clevis 76, which is connected to a drive housing 78, is rotatably connected to each of the first and second motor support links 72, 74 by a support pin 80. The drive housing 78 is therefore rotatably supported to the first and second motor support links 72, 74. An electric motor 82, such as a DC motor, is mounted to the drive housing 78 and acts, when energized, to linearly extend or retract a drive tube 118 (shown and described in reference to FIGS. 10 and 12) positioned within a drive tube support housing 84 which is oppositely fixedly connected to the drive housing 78 with respect to the support clevis 76. The electric motor 82 acts when energized in a first mode (defined as an extend command provided by the occupant via for example a motor control switch or hand wand, not shown) to extend the leg rest assembly 22 away from the stowed position toward the fully extended position, and acts when energized in a second mode (defined as a retract command given by the occupant) to return the leg rest assembly 22 from the fully extended to the stowed position. The first mode causes rotation of electric motor 82 in a first rotational direction and the second mode causes rotation in a second, opposite rotational direction. Alternately, the electric motor 82 can operate in a single rotational direction, and a gear or transmission/clutch system of the drive housing 78 can be oppositely actuated to provide the extension and retraction motions of leg rest assembly 22.

In order to cover the link members that are used to extend leg rest assembly 22 when the leg rest assembly is moved to the fully extended forward, fully extended clockwise rotated and/or fully extended counterclockwise rotated positions, a first clamshell housing 86 is rotatably linked to the mechanism housing 70 by a first connecting bracket 88. A second clamshell housing 90 is rotatably linked to the first clamshell housing 86 using a rotational fastener 92. Similarly, but on a left hand side of mechanism housing 70, a third clamshell housing 94 is rotatably linked to the mechanism housing 70 by a second connecting bracket 96. A fourth clamshell housing 98 is rotatably linked to the third clamshell housing 94 using a rotational fastener 100 (not clearly visible in this view).

Each of the first, second, third, and fourth clamshell housings 86, 90, 94, 98 are freely displaceable through a panel aperture 102 created in frame panel 30. A linkage assembly defining a completely enclosed linkage assembly which functions similar to a pantograph linkage assembly (shown and described more clearly in reference to FIGS. 13-15) is housed within the first, second, third, and fourth clamshell housings 86, 90, 94, 98 and connects mechanism housing 70 to a leg rest mount board 104. The leg rest mount board 104 is shown without upholstery for clarity. In the fully retracted position of the leg rest assembly 22 shown, the leg rest mount board 104 is positioned proximate to and can be in direct contact with frame panel 30. During operation of motor 82, the leg rest mount board 104 is rotated freely away from frame panel 30 to achieve the leg rest extended positions shown and described in reference to FIGS. 3 and 7-8.

Figure 8:
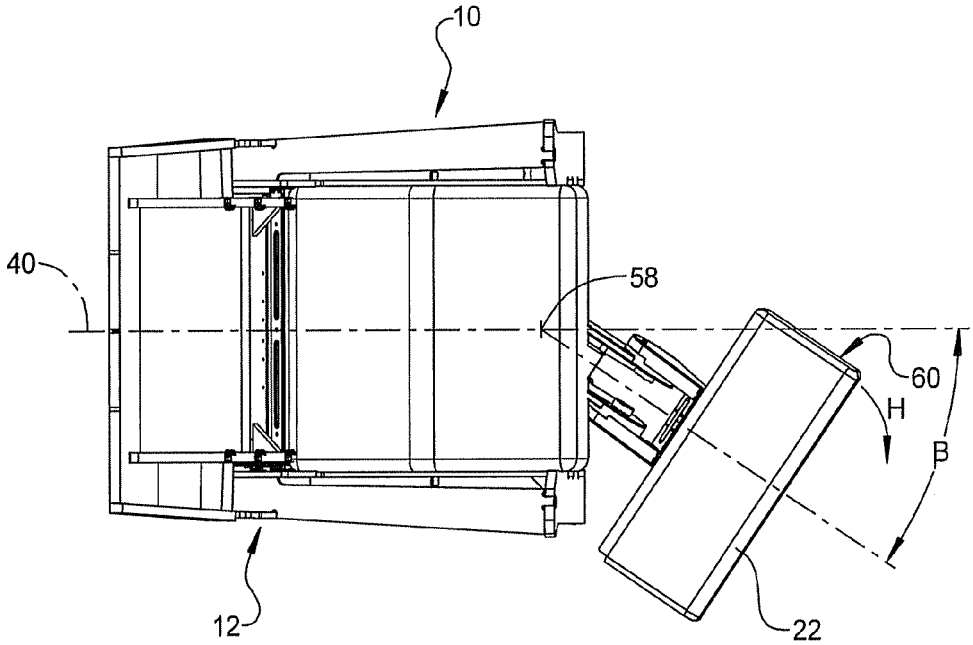
FIG. 8 is a top plan view of the furniture member with the leg rest assembly in a fully extended clockwise rotated position.

Because the leg rest mount board 104 can rotate with respect to leg rest axis of rotation 58 when the leg rest assembly 22 is in its fully extended position, a detent assembly 106 is provided to releasably retain the leg rest assembly 22 in its fully extended forward/center position and each of the maximum clockwise and counterclockwise rotated positions described in reference to FIGS. 5, 7, and 8. Detent assembly 106 includes a disc having three detent recessions 108 which are individually engaged by a detent pin 110 defining each of the leg rest extended and releasably retained positions. Detent pin 110 is fixed in a flange 112 which also retains the first and second support tubes 66, 68. Detent assembly 106 is biased by a detent assembly spring 114 which initially biases the leg rest assembly 22 to the fully extended center position upon extension of the leg rest assembly 22.

Detent assembly 106 is further capable of releasably retaining leg rest assembly 22 at the full extent of its rotation in either the clockwise or counterclockwise directions. The detent assembly 106 is coaxially aligned with and rotatably supported by a detent alignment pin 116 rotatably supported by the flange 112. A longitudinal central axis of detent alignment pin 116 also defines the leg rest axis of rotation 58. Detent alignment pin 116 and axis of rotation 58 are oriented substantially vertically with respect to an occupant of the furniture member 10 in the upright furniture member position shown in FIG. 2, both being oriented normal to the plane defined by floor surface 26, and also normal to lateral centerline 40 of furniture member 10. The detent alignment pin therefore rotatably connects the leg rest assembly 22 to the base member 12 defining the leg rest axis of rotation 58, which permits the leg rest assembly 22 to be manually rotated by the occupant of the furniture member 10 about the leg rest axis of rotation 58 to each of the fully extended clockwise rotated position and the fully extended counterclockwise rotated position following operation of the motor 82 extending the leg rest assembly 22 to the fully extended position. In the fully retracted position shown for leg rest mechanism 28, all of the components of the drive assembly, including the motor 82 and the first, second, third, and fourth clamshell housings 86, 90, 94, 98 are positioned flush to or rearward of the frame panel 30, which therefore positions the leg rest mechanism 28 substantially entirely within the base member 12.

Figure 9:
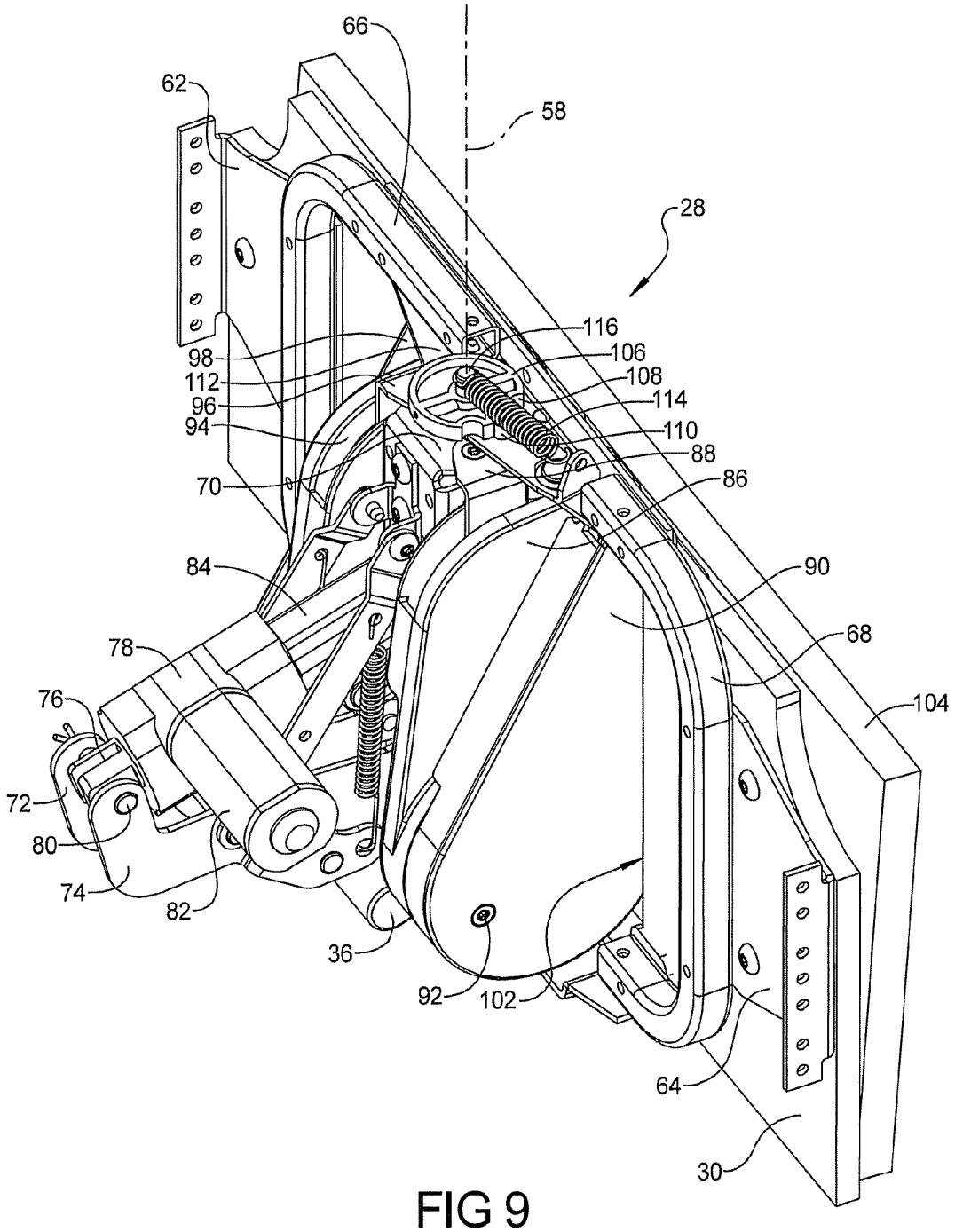
FIG. 9 is a right side perspective view looking forward of a leg rest mechanism of the present disclosure.

Referring to FIG. 10 and again to FIG. 9, the first and second clamshell housings 86, 90 are positioned in opposed relationship about the leg rest axis of rotation 58 with respect to the third and fourth clamshell housings 94, 98. The first, second, third, and fourth clamshell housings 86, 90, 94, 98 are actuated by operation of the motor 82, as previously described, which linearly extends a leg rest drive tube 118 from the drive tube support housing 84. The leg rest drive tube 118 is coupled to an engagement plate 120 which in turn is coupled to each of the first and third clamshell housings 86, 94. A lower flange 122 supports lower ends of the first and second support tubes 66, 68. In the leg rest assembly 22 stowed position, the first and second clamshell housings 86, 90 are partially received in a U-shaped trough 124 of the lower flange 122, and the third and fourth clamshell housings 94, 98 are partially received in a U-shaped trough 126 of the lower flange 122. Linear extension of the leg rest drive tube 118 from the drive tube support housing 84 causes a forward/outward rotation of the engagement plate 120 and thereby extension of the first, second, third, and fourth clamshell housings 86, 90, 94, 98 outward through the panel aperture 102 of frame panel 30 (away from the viewer as shown in FIG. 10).

Figure 10:
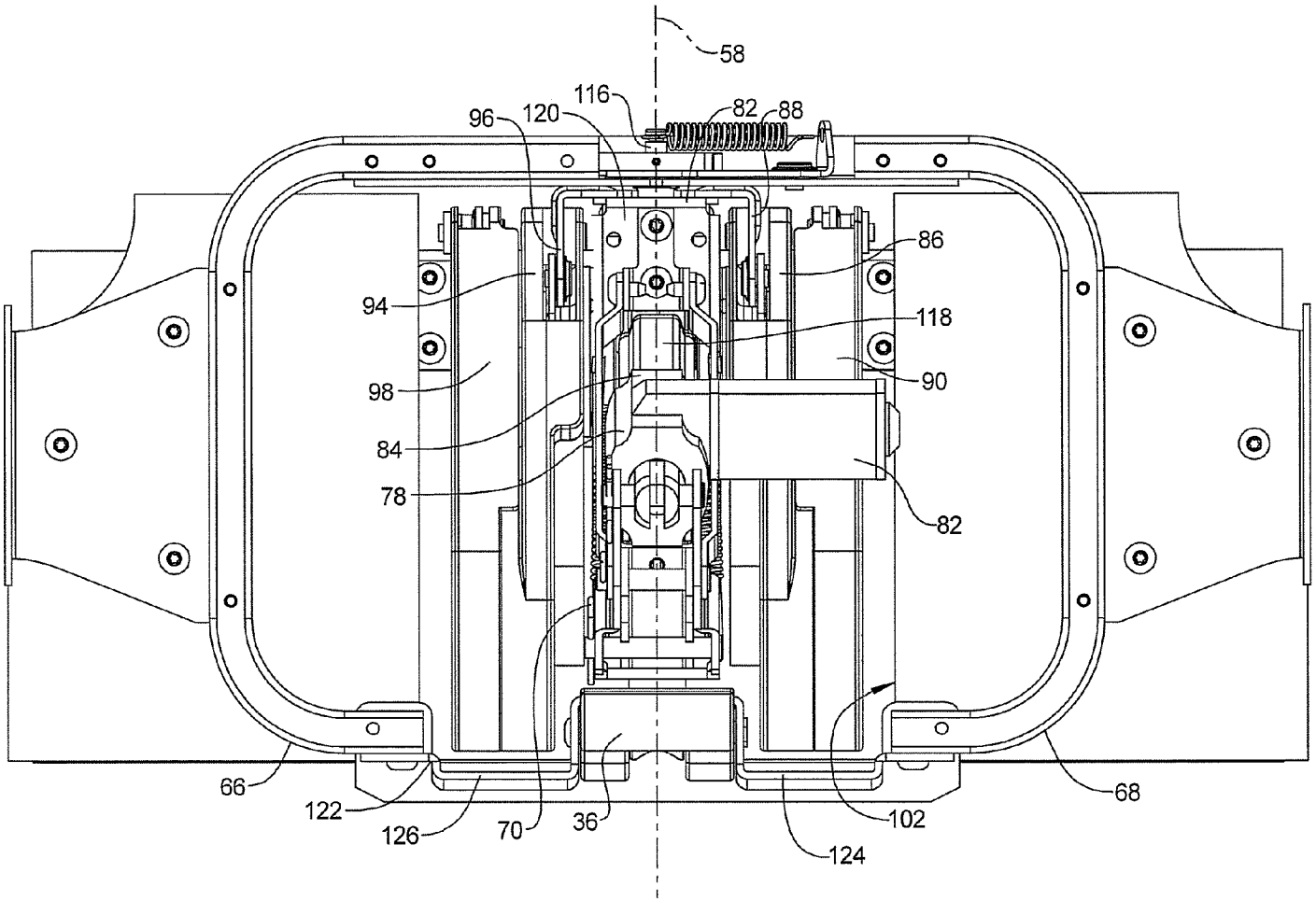
FIG. 10 is an end elevational view looking forward of the leg rest mechanism of FIG. 9.
Figure 11:
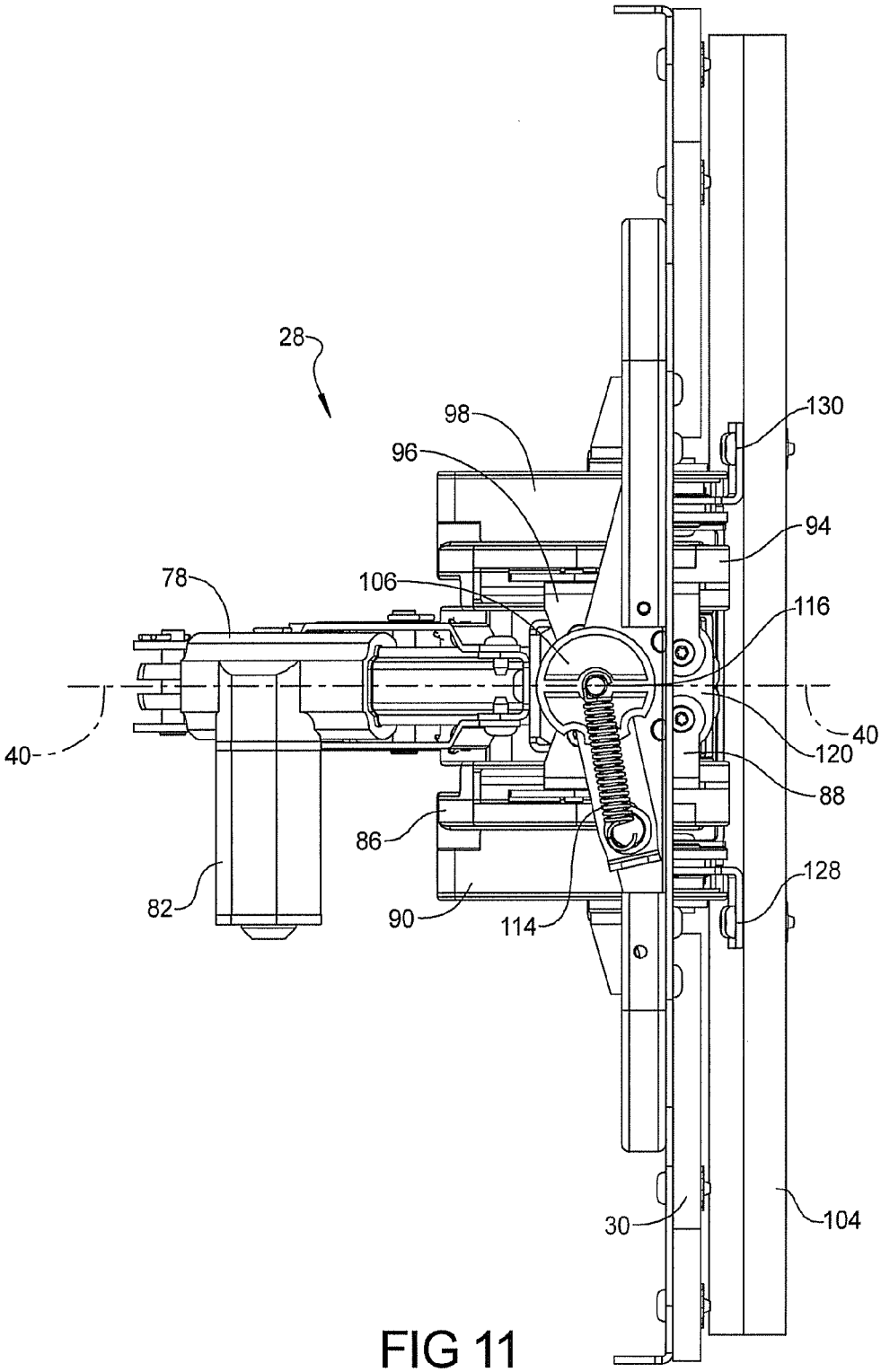
FIG. 11 is a top plan view of the leg rest mechanism of FIG. 10.

Referring to FIG. 11 and again to FIGS. 9-10, the first connecting bracket 88 is fixed to the mechanism housing 70 and the first clamshell housing 86 is rotatably connected to the first connecting bracket 88. Similarly, the second connecting bracket 96 is fixed to the mechanism housing 70 and the third clamshell housing 94 is rotatably connected to the second connecting bracket 96. The engagement plate 120 is rotatably connected to the leg rest drive tube 118 and fixed to each of the first and third clamshell housings 86, 94 such that linear extension of the leg rest drive tube 118 from the drive tube support housing 84 rotates the engagement plate 120 and thereby rotates the first and third clamshell housings 86, 94. The second clamshell housing 90 is rotatably connected to the first clamshell housing 86 and is rotatably connected to the leg rest mount board 104 using a first mounting bracket 128. Similarly, the fourth clamshell housing 98 is rotatably connected to the third clamshell housing 94 and is rotatably connected to the leg rest mount board 104 using a second mounting bracket 130.

Referring to FIG. 12 and again to FIGS. 7 and 9-11, the leg rest mount board 104 is shown in its fully extended position and at the fully clockwise rotated position with respect to the leg rest axis of rotation 58. Full axial or linear extension of the leg rest drive tube 118 by operation of motor 82 directly forwardly rotates the engagement plate 120 to which is fixedly connected the first clamshell housing 86 and the third clamshell housing 94. The first clamshell housing 86 is rotatably connected to the first connecting bracket 88 using a clamshell rotational pin 132. The third clamshell housing 94 is rotatably connected to the second connecting bracket 96 using a clamshell rotational pin 134 (only partially visible in this view). After powered extension of the leg rest mount board 104, a manual force is applied to rotate either to the clockwise rotated position (shown) or the counterclockwise position (shown in FIG. 7).

In addition to the clamshell rotational pins 132, 134, to assist in extension and support of the leg rest assembly 22, a first support link 136 is rotatably connected to the first connecting bracket 88 by a rotational fastener 138, and a second support link 140 is rotatably connected to the second connecting bracket 96 by a rotational fastener 142 (only partially visible in this view). The first and second support links 136, 140 are positioned substantially within and therefore covered by the first and third clamshell housings 86, 94 at all positions of the first and third clamshell housings 86, 94. Outward rotation of engagement plate 120 therefore causes rotation of the first clamshell housing 86 with respect to both clamshell rotational pin 132 and to rotational fastener 138, and causes rotation of third clamshell housing 94 with respect to both clamshell rotational pin 134 and to rotational fastener 142. A cross brace 144 fixedly connects the second clamshell housing 90 to the fourth clamshell housing 98, thereby providing rigidity between these members to maintain a continuous spacing and support the members.

Referring to FIG. 13 and again to FIGS. 9-12, the leg rest assembly 22 is shown in the leg rest fully extended position with the leg rest mount board 104 positioned at the fully counterclockwise rotated position. For clarity, covers of the first and second clamshell housings 86, 90 are spatially separated. The following discussion of the components and covers of the first and second clamshell housings 86, 90 applies equally to the components and covers of the third and fourth clamshell housings 94, 98, which are mirror image arrangements of the first and second clamshell housings 86, 90.

In order to at least substantially enclose the link members that are provided within the first and second clamshell housings 86, 90, a first cover plate 146 is provided for first clamshell housing 86 and a second cover plate 148 is provided with second clamshell housing 90. A third cover plate 150 (shown installed) is provided for third clamshell housing 94 and a fourth cover plate 152 (shown installed) is provided with fourth clamshell housing 98. The first support link 136 extends through a cavity 153 created between the first clamshell housing 86 and first cover plate 146, and is therefore substantially covered by the first clamshell housing 86 and first cover plate 146. The first support link 136 is rotatably connected at a far end to second clamshell housing 90 using a rotational fastener 154. First and second mount fasteners 156, 158 connected to engagement plate 120 extend through first clamshell housing 86 and into apertures 160, 162 of first cover plate 146 to retain first cover plate 146 and first clamshell housing 86 on engagement plate 120. First cover plate 146 also includes a molded or cast ring base 164 having an aperture 166 which rotatably receives the clamshell rotational pin 132 extending from first connecting bracket 88, allowing first clamshell housing 86 to rotate about clamshell rotational pin 132.

First cover plate 146 further includes a circular housing end 168 which is rotationally coupled to a semi-circular end 170 of first clamshell housing 86, which together close off a free end of first clamshell housing 86. A circular cavity 172, created in circular housing end 168, includes a molded or cast ring base 174 having an aperture 176. A fastener 178 extending through semi-circular end 170, second clamshell housing 90, and ring base 174 rotatably couples second clamshell housing 90 to first clamshell housing 86. To rotate and extend leg rest mount board 104, a first mount board link 180 (a second mount board link 181 positioned in fourth clamshell housing 98 is also partially visible in FIG. 13) is pinned using a pin 182 received in a curved elongated slot 184 (positioned in the circular cavity 172 of first cover plate 146) and an axially aligned curved elongated slot 186 (created in second clamshell housing 90). Similar to first support link 136, the mount board link 180 is positioned substantially within a cavity 187 created between the second clamshell housing 90 and second cover plate 148. The mount board link 180 is therefore substantially covered by second clamshell housing 90 and second cover plate 148 at all rotated positions of second clamshell housing 90.

When the second clamshell housing 90 outwardly rotates to the leg rest extended position shown, the pin 182 displaces away from a first end 188 of elongated slot 186 and contacts a second end 190 of elongated slot 186. The second cover plate 148 is attached to second clamshell housing 90 using a fastener (not shown) extending through an aperture 192 of second cover plate 148 into a raised member 194 of second clamshell housing 90. A rotational fastener 196 is also received through second clamshell housing 90, the first mounting bracket 128, and a second aperture 198 of second cover plate 148, allowing rotation of leg rest mount board 104.

The first and second support links 136, 140 in each of the first and third clamshell housings 86, 94 and the first and second mount board links 180, 181 positioned in each of the second and fourth clamshell housings 90, 98 together define a completely enclosed linkage assembly. When the occupant of the furniture member manually displaces the leg rest assembly 22 to either the clockwise or counterclockwise rotated positions, the first and second support links 136, 140 and the first and second mount board links 180, 181 are prevented from being directly contacted by the occupant by their position within the first, second, third, and fourth clamshell housings 86, 90, 94, 98 and by the various cover plates.

Figure 12:
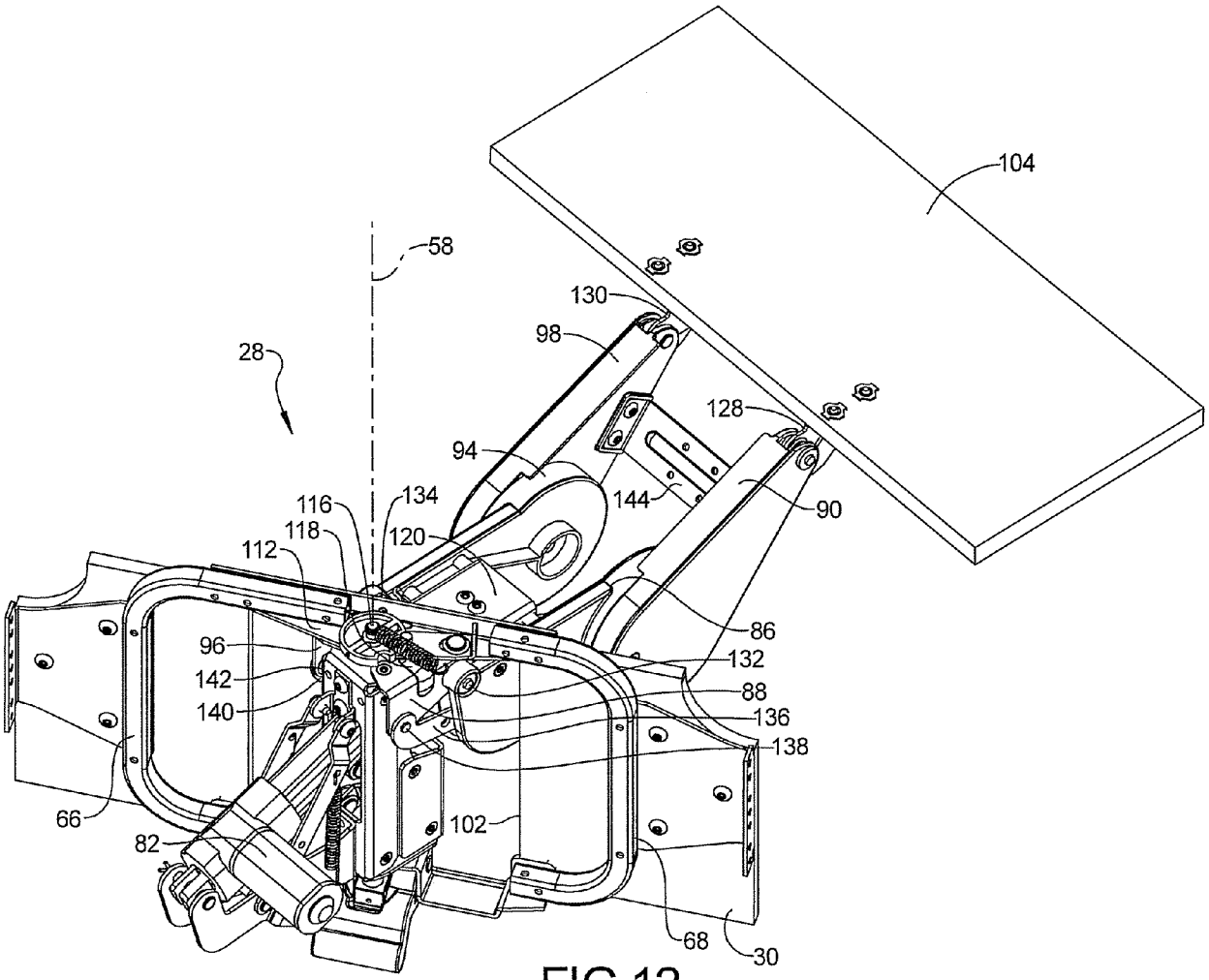
FIG. 12 is a right side perspective view looking forward of the leg rest mechanism of FIG. 9, further showing the leg rest member in the fully extended clockwise rotated position.
Figure 13:
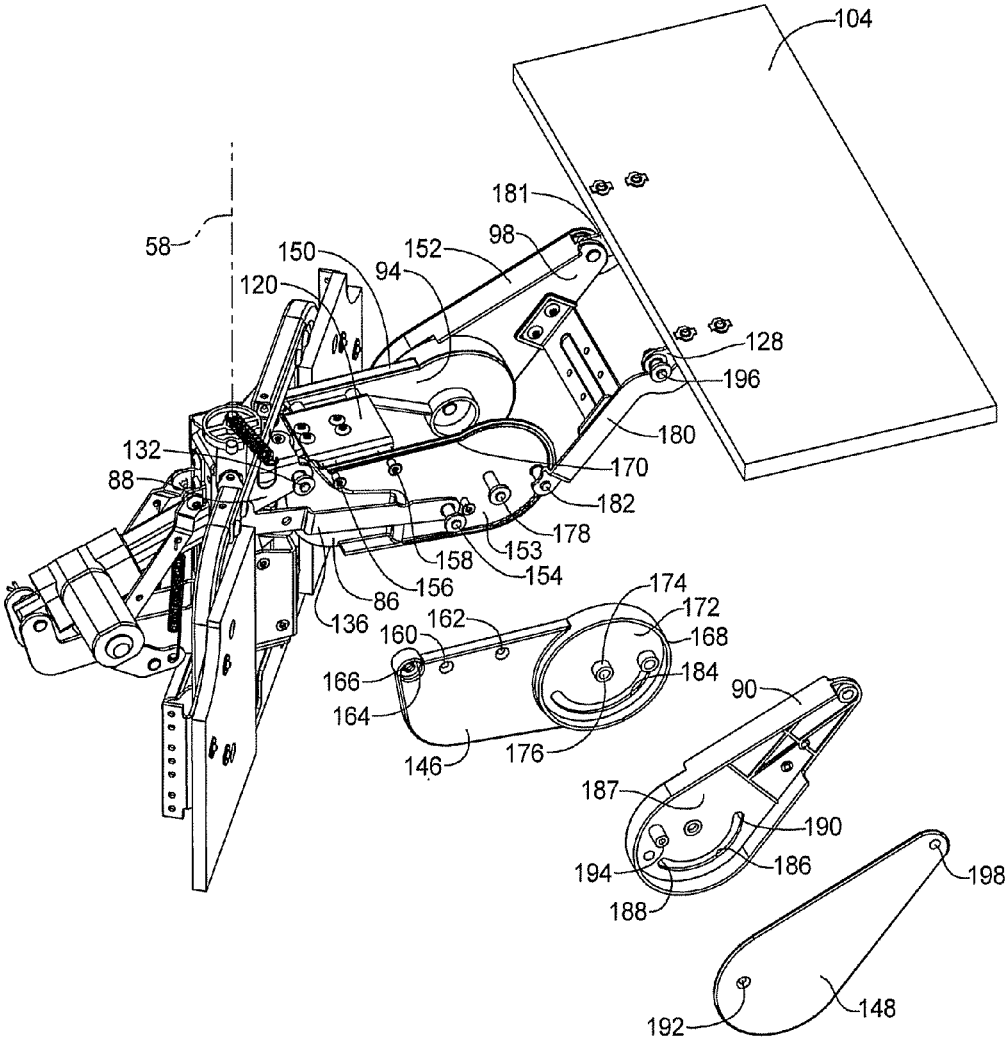
FIG. 13 is a right side perspective partial assembly view looking rearward of the leg rest mechanism, showing the leg rest member in the fully extended counterclockwise rotated position.

Referring to FIG. 14 and again to FIGS. 12-13, an assembly of the engagement plate 120, first connecting bracket 88, first support link 136, and first clamshell housing 86 is provided, with the second clamshell housing 90 removed for clarity. As the leg rest drive tube 118 extends linearly outwardly from drive tube support housing 84 in the extending direction "L", the engagement plate 120, which is rotatably connected to first connecting bracket 88 using clamshell rotational pin 132, is induced to rotate in a counterclockwise direction of rotation "N". First support link 136 is rotatably connected to first connecting bracket 88 by rotational fastener 138 and is slidably pinned using pin 182 positioned within and guided by the walls of elongated curved slot 186 created in first clamshell housing 86. As first clamshell housing 86 rotates in the counterclockwise direction of rotation "N", pin 182 displaces within slot 186 from the first slot end 188' to the opposite second slot end 190' (shown). Both engagement plate 120 and pin 182 therefore support first clamshell housing 86 in its extended position.

Figure 14:
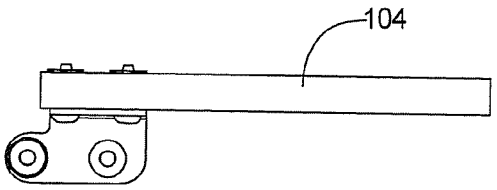
FIG. 14 is a right side elevational view of a portion of the leg rest mechanism of FIG. 12, with the leg rest assembly in the fully extended position, showing components of a first clamshell housing.
Figure 14:
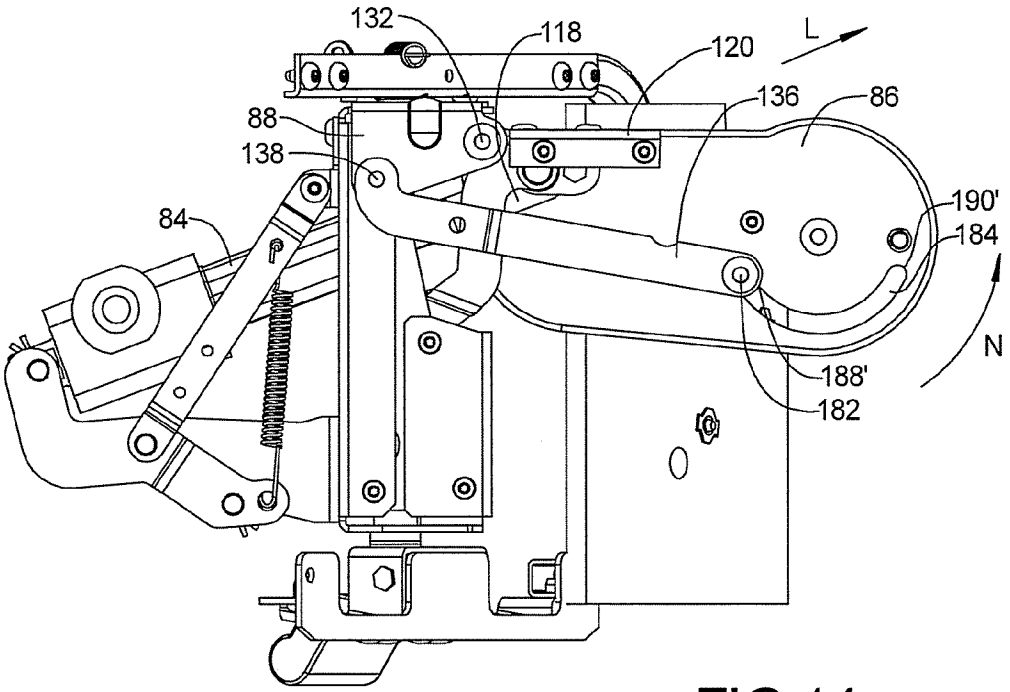
Figure 15:
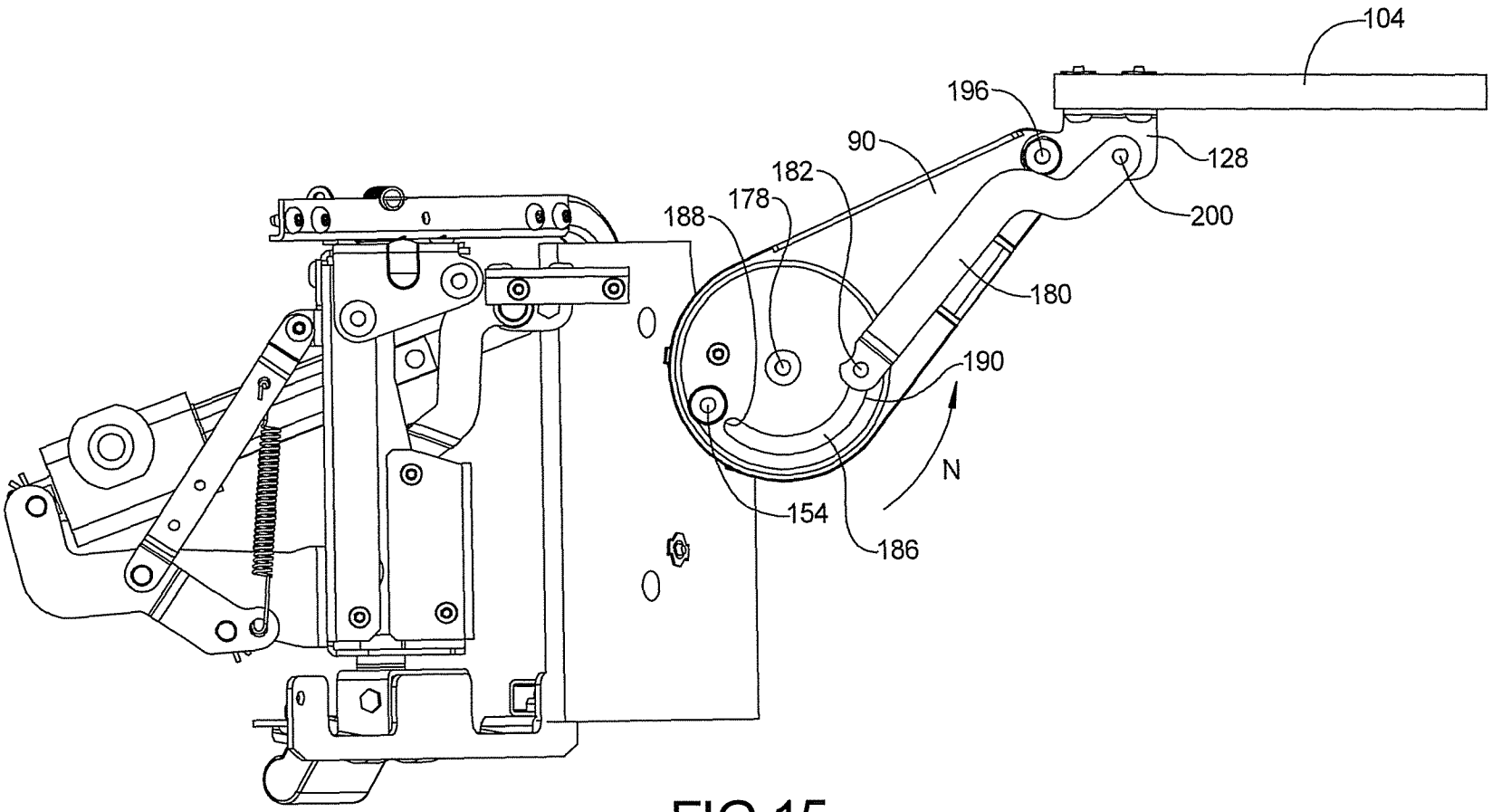
FIG. 15 is a right side elevational view of a portion of the leg rest mechanism modified from FIG. 14 to identify internal components of a second clamshell housing.

Referring to FIG. 15 and again to FIG. 14, first clamshell housing 86 is removed for clarity. Second clamshell housing 90 is rotatably connected to first clamshell housing 86, using rotational fastener 178, and by rotational fastener 154. Outward rotation of first clamshell housing 86 induces rotation of second clamshell housing 90 to position leg rest mount board 104 in its fully extended position shown. The first mounting bracket 128 is rotatably connected to a distal end of second clamshell housing 90 using a rotational fastener 196. A second rotational fastener 200 is also rotatably connected to first mounting bracket 128, as well as to mount board link 180. An opposite end of mount board link 180 is pinned using pin 182 positioned within and guided by the elongated curved slot 186 created in second clamshell housing 90. As second clamshell housing 90 rotates in the counterclockwise direction of rotation "N", pin 182 displaces within slot 186 from the first slot end 188 to the opposite second slot end 190, outwardly extending mount board link 180 and rotating leg rest mount board 104 to the fully extended position.

The first, second, third, and fourth clamshell housings 86, 90, 94, 98 provide two functions: 1) to substantially cover the link members (first and second support links 136, 140, and the first and second mount board links 180, 181) received therein, and 2) to act as structural members to provide structural support for leg rest mount board 104. The covers, such as 146, 148, 150, 152, further provide both a covering function for the link members positioned within the first, second, third, and fourth clamshell housings 86, 90, 94, 98 as well as defining further structural members acting to provide additional structural support for the leg rest mount board 104. The first, second, third, and fourth clamshell housings 86, 90, 94, 98 and the covers, such as 146, 148, 150, 152 therefore act to replace pantograph or duplicate links commonly found in leg rest assemblies, while also providing a covering function such that additional upholstery cover material commonly used in pantograph link leg rest assemblies is not required to cover the first, second, third, or fourth clamshell housings 86, 90, 94, 98 at all extended and/or stowed positions.

A furniture member leg rest mechanism 28 of the present disclosure includes a leg rest assembly 22 connected to a base member 12 of a furniture member 10 and extensible away from a stowed position (shown in FIG. 1) by movement in a direction "D" coincident with a lateral centerline 40 of the furniture member 10 to a fully extended position of the leg rest assembly (shown in FIG. 3). A leg rest mechanism 28 is connected to the base member 12 and the leg rest assembly 22. A completely enclosed linkage assembly includes a first clamshell housing 86 rotatably connected to the leg rest mechanism 28 and a second clamshell housing 94 rotatably connected to the first clamshell housing 86 and to a leg rest mount board 104 of the leg rest assembly 22.

Example embodiments are provided so that this disclosure will be thorough and will fully convey the scope to those who are skilled in the art. Numerous specific details are set forth, such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member leg rest assembly, comprising:

a leg rest assembly connected to a base frame of a furniture member and extensible away from a stowed position by movement in a direction coincident with a lateral centerline of the furniture member to a fully extended position of the leg rest assembly;

a leg rest mechanism connected to the base frame and the leg rest assembly; and a linkage assembly, including:

a first clamshell housing rotatably connected to the leg rest mechanism; and a second clamshell housing rotatably connected to the first clamshell housing and to a leg rest mount board of the leg rest assembly.

2. The furniture member leg rest assembly of claim 1, wherein the leg rest mechanism further includes a motor operated to linearly extend and retract a leg rest drive tube.

3. The furniture member leg rest assembly of claim 2, further including a pin rotatably connecting the leg rest mechanism to the base frame defining a leg rest axis of rotation permitting the leg rest assembly to be manually rotated by the occupant of the furniture member about the leg rest axis of rotation to each of a fully extended clockwise rotated position and a fully extended counterclockwise rotated position following operation of the motor, linearly extending the leg rest drive tube which thereby extends the leg rest assembly to the fully extended position.

4. The furniture member leg rest assembly of claim 2, wherein the leg rest mechanism further includes an engagement plate fixedly connected to the first and second clamshell housings and rotated by extension of the leg rest drive tube.

5. The furniture member leg rest assembly of claim 1, further including:

a first support link rotatably connected to both the leg rest mechanism and to the first clamshell housing; and a first mount board link rotatably connected by a rotational fastener to the first clamshell housing, the first mount board link further rotatably connected by a second rotational fastener to the leg rest mount board.

6. The furniture member leg rest assembly of claim 5, further including:

a first cover plate connected to the first clamshell housing and substantially covering the first support link, and a second cover plate connected to the second clamshell housing and substantially covering the first mount board link.

7. The furniture member leg rest assembly of claim 6, further including:

a first connecting bracket fixedly connected to the leg rest mechanism; and wherein the first cover plate includes a ring base having an aperture which rotatably receives a clamshell rotational pin extending from the first connecting bracket, allowing the first clamshell housing to rotate about the clamshell rotational pin.

8. The furniture member leg rest assembly of claim 6, wherein the first clamshell housing, the first support link, the second clamshell housing, and the first mount board link are together rotatable from an initial position substantially within the base frame to an extended position outside of the base frame defining the fully extended position of the leg rest member.

9. The furniture member leg rest assembly of claim 5, wherein the rotational fastener extends through a curved elongated slot of the second clamshell housing and displaces from a first end of the elongated slot at the stowed position of the leg rest assembly to a second end of the elongated slot defining the fully extended position of the leg rest assembly.

10. The furniture member leg rest assembly of claim 5, wherein the first cover plate includes a circular housing end which is rotationally coupled to a semi-circular end of the first clamshell housing, the circular housing end and the semi-circular end together closing off a free end of the first clamshell housing.

11. A furniture member leg rest assembly, comprising:

a leg rest assembly connected to a base frame of a furniture member and extensible away from a stowed position by movement in a direction coincident with a lateral centerline of the furniture member to a fully extended position of the leg rest assembly;

a leg rest mechanism connected to the base frame and the leg rest assembly; and a linkage assembly, including:

a first clamshell housing rotatably connected to the leg rest mechanism having a first extension link also rotatably connected to the leg rest mechanism positioned within the first clamshell housing; and a second clamshell housing rotatably connected to the first clamshell housing and to a leg rest mount board of the leg rest assembly having a first mount board link positioned within the second clamshell housing also rotatably connected to the first clamshell housing and to the leg rest mount board.

12. The furniture member leg rest assembly of claim 11, wherein the leg rest mechanism further includes a third clamshell housing rotatably connected to the leg rest mechanism having a second extension link also rotatably connected to the leg rest mechanism positioned within the third clamshell housing.

13. The furniture member leg rest assembly of claim 12, wherein the leg rest mechanism further includes a fourth clamshell housing rotatably connected to the third clamshell housing and to the leg rest mount board of the leg rest assembly having a second mount board link positioned within the fourth clamshell housing also rotatably connected to the third clamshell housing and to the leg rest mount board.

14. The furniture member leg rest assembly of claim 13, wherein the engagement plate is rotated by actuation of an electric motor acting to linearly extend a leg rest drive tube connected to the engagement plate.

15. The furniture member leg rest assembly of claim 12, wherein the leg rest mechanism further includes an engagement plate, the engagement plate fixed to each of the first and third clamshell housings and rotated during extension of the leg rest mount board.

16. The furniture member leg rest assembly of claim 11, further including a pin rotatably connecting the leg rest mechanism to the base frame defining a leg rest axis of rotation, the leg rest assembly being manual rotatable by a furniture member occupant about the leg rest axis of rotation to each of a fully extended clockwise rotated position and a fully extended counterclockwise rotated position following operation of an electric motor linearly extending a leg rest drive tube thereby extending the leg rest assembly to the fully extended position.

17. A furniture member, comprising:

a leg rest mechanism connected to a base frame of a furniture member;

a leg rest assembly connected to the leg rest mechanism and extensible away from a stowed position to a fully extended position of the leg rest assembly by operation of an electric motor, the leg rest assembly including:

a linkage assembly, including:

first and third clamshell housings individually rotatably connected to the leg rest mechanism; and second and fourth clamshell housings each rotatably connected to one of the first or third clamshell housings and both further rotatably connected to a leg rest mount board; and a pin rotatably connecting the leg rest mechanism to the base frame defining a leg rest axis of rotation permitting the leg rest assembly to be manually rotated by an occupant of the furniture member about the leg rest axis of rotation to each of a fully extended clockwise rotated position and a fully extended counterclockwise rotated position following operation of the electric motor extending the leg rest assembly to the fully extended position.

18. The furniture member leg rest assembly of claim 17, further including:

a first extension link rotatably connected to a first connection bracket fixed to the leg rest mechanism, the first extension link disposed within the first clamshell housing; and a second extension link rotatably connected to a second connection bracket fixed to the leg rest mechanism, the second extension link disposed within the third clamshell housing.

19. The furniture member leg rest assembly of claim 18, further including:

a cover plate connected to the first clamshell housing creating a first clamshell cavity between the cover plate and the first clamshell housing substantially completely enclosing the first extension link within the first clamshell cavity; and a cover plate connected to the third clamshell housing creating a third clamshell cavity between the cover plate and the third clamshell housing substantially completely enclosing the second extension link within the third clamshell cavity.

20. The furniture member leg rest assembly of claim 18, wherein:

the first extension link is connected using a first pin positioned within and guided by an elongated curved slot created in the first clamshell housing; and the second extension link is connected using a second pin positioned within and guided by an elongated curved slot created in the third clamshell housing.

21. The furniture member leg rest assembly of claim 20, wherein:

the second clamshell housing is rotatably connected to the first clamshell housing using a rotational fastener and by the first pin such that an outward rotation of the first clamshell housing induces rotation of the second clamshell housing; and the fourth clamshell housing is rotatably connected to the third clamshell housing using a rotational fastener and by the second pin such that an outward rotation of the third clamshell housing induces rotation of the fourth clamshell housing.

22. The furniture member leg rest assembly of claim 18, wherein the second and fourth clamshell housings each include a mounting bracket connected to a distal end of the second and fourth clamshell housings and to the leg rest mount board.

23. The furniture member leg rest assembly of claim 17, further including a leg rest drive tube axially extensible by operation of the electric motor and connected to the leg rest assembly to provide power extension and retraction of the leg rest assembly.

24. A furniture member leg rest assembly, comprising:

a leg rest assembly;

a leg rest mechanism connected to the leg rest assembly; and a linkage assembly, including:

a first clamshell housing rotatably connected to the leg rest mechanism having a first support link substantially enclosed within the first clamshell housing; and a second clamshell housing rotatably connected to the first clamshell housing and to a leg rest mount board of the leg rest assembly, the second clamshell housing having a first mount board link substantially enclosed within the second clamshell housing, the first and second clamshell housings together with the first support link and the first mount board link defining structural support members for the leg rest mount board.

25. The furniture member leg rest assembly of claim 24, further including a third clamshell housing rotatably connected to the leg rest mechanism having a second support link substantially enclosed within the third clamshell housing.

26. The furniture member leg rest assembly of claim 25, further including a fourth clamshell housing rotatably connected to the third clamshell housing and to the leg rest mount board of the leg rest assembly, the fourth clamshell housing having a second mount board link substantially enclosed within the fourth clamshell housing, the third and fourth clamshell housings together with the second support link and the second mount board link defining structural support members for the leg rest mount board.

27. The furniture member leg rest assembly of claim 24, wherein the first and second clamshell housings substantially cover the first support link and the first mount board link positioned within the first and second clamshell housings between a stowed position and a fully extended position of the leg rest assembly.

28. The furniture member leg rest assembly of claim 24, further including a cover individually connected to each of the first and second clamshell housings, each cover providing a covering function for the first support link or the first mount board link and acting as a structural support member for the leg rest mount board.

29. The furniture member leg rest assembly of claim 24, further including a base frame of a furniture member having the leg rest mechanism further connected to the base frame, the leg rest assembly extensible away from a stowed position by movement in a direction coincident with a lateral centerline of the furniture member to a fully extended position of the leg rest assembly.

* * * * *